United States Patent [19]

Dowis

[11] 4,252,201

[45] Feb. 24, 1981

[54] DRILLING METHOD AND APPARATUS

[76] Inventor: James W. Dowis, 465 Summit, Colby, Kans. 67701

[21] Appl. No.: 69,630

[22] Filed: Aug. 27, 1979

[51] Int. Cl.[3] ..... C21B 7/00; C21B 10/00

[52] U.S. Cl. ..... 175/57; 175/279; 175/379

[58] Field of Search ..... 175/78, 94, 101, 106, 175/107, 279, 379, 57; 173/146

[56] References Cited

U.S. PATENT DOCUMENTS

| | | | |
|---|---|---|---|
| 1,350,059 | 8/1920 | Blackwell | 175/106 X |
| 1,938,412 | 12/1933 | Wright | 175/379 |
| 2,067,693 | 1/1937 | Carey | 175/78 |
| 2,181,980 | 12/1939 | Seale | 175/78 |
| 2,198,849 | 4/1940 | Waxler | 175/379 X |
| 2,586,842 | 2/1952 | McCallum | 173/146 |
| 3,075,593 | 1/1963 | Holsing | 175/383 |
| 3,232,362 | 2/1966 | Cullen et al. | 173/146 X |
| 3,804,544 | 4/1974 | Adams | 173/146 X |
| 3,899,033 | 8/1975 | Van Huisen | 175/106 X |

FOREIGN PATENT DOCUMENTS

| | | | |
|---|---|---|---|
| 633195 | 7/1936 | Fed. Rep. of Germany | 175/78 |

*Primary Examiner*—James A. Leppink
*Assistant Examiner*—George A. Suchfield
*Attorney, Agent, or Firm*—Newton, Hopkins & Ormsby

[57] ABSTRACT

A drill having plural forwardly projecting circumferentially spaced cutting bits includes a hydraulic motor operated at full drilling fluid pressure to drive the cutting bits in unison through a first one-way clutch in a drilling mode. A centrifugal device responding to higher speed rotation of the drill operates a reversing valve connected with the hydraulic motor to reverse it at required times to incrementally advance the cutting bits of the drill in unison to compensate for wear and present a new sharp cutting face on each bit for continued drilling. The reversal of rotation of the bits is transmitted from the hydraulic motor through a second one-way clutch of the single revolution type which drives a pinion common to and in mesh with drive gears individual to the several cutting bits and matching the shapes of their flutes and being axially slidable relative thereto. Locking rings individual to the drill bits and threadedly engaged therewith are coupled through paired clutch springs to the casing of the drill and to clutch sleeves individual to the bits and, in turn, fixed to their driving gears.

11 Claims, 6 Drawing Figures

DRILLING METHOD AND APPARATUS

BACKGROUND OF THE INVENTION

The invention relates to a drilling apparatus and method whereby the plural cutting bits of the apparatus may be repositioned following wear caused by drilling to present fresh sharpened faces without the necessity for removing the drilling apparatus from the well.

Prior U.S. Pat. No. 1,938,412 discloses a well drilling tool including a bit having a cutting part which can be automatically advanced relative to its support to compensate for wear caused by drilling. The arrangement disclosed in this patent is dependent upon coordinated fluid pressure and spring-biasing means for the cutting part of the bit and for this reason is not desirable for the types of drilling operations which the present invention must encounter. The present invention differs drastically in its mode of operation from U.S. Pat. No. 1,938,412 in that the invention includes a positive acting repositioning means for the worn bits responding to a deliberate action by the drilling operator without dependency on springs or other automatic biasing means and without the necessity for removing the drilling apparatus from the well.

Another U.S. Pat. No. 2,198,849 discloses a drill bit having rolling type abraiding cutters and additional spring-urged blades but totally lacking the operational capabilities of the present invention.

Still another U.S. Pat. No. 3,075,593 discloses a drill bit having plural cutting elements which are removable and replaceable after becoming worn, but this arrangement requires total removal of the drilling bit from the well.

SUMMARY OF THE INVENTION

A casing section includes a threaded rear adapter for coupling the casing section to a drill string in a well. At its forward end, the casing section carries plural oblique axis circumferentially spaced forwardly and radially projecting fluted cutting bits which are individually driven simultaneously in rotation by gears mounted in the casing section and encircling the bits. These bit driving gears, in turn, are driven by a common central pinion on an axial shaft driven by a hydraulic motor inside of the casing section. The flutes of the bits are threaded on their peripheral surfaces, and internally threaded locking rings engaged these screw-threads abut corresponding end faces of the individual bit drive gears during a forward drilling mode to lock the locking rings to the gears by means of one-way clutches between the rings and gears, thereby preventing axial movement of the cutting bits and transferring the pressure imposed on the forward ends of the cutting bits resulting from their cutting action to the body or casing of the drill.

In order to advance the individual cutting bits in unison after wear has occurred on them so that fresh cutting surfaces are presented, the hydraulic motor and the common pinion gear operated by it are driven in reverse. At this time, the individual bit driving gears slip relative to their respective locking rings due to reverse rotation of the associated one-way clutches. Secondary one-way clutches between the locking rings and the casing section prevent rotation of the locking rings at these times. The cutting bits, therefore, thread themselves through the threaded locking rings and thereby advance forwardly on the casing to present new sharp cutting surfaces at their forwardmost ends. This advancing of the cutting bits is limited to an incremental amount, irrespective of the number of reverse revolutions of the hydraulic drive motor, because of a one-revolution clutch interposed between this motor and the common drive pinion, thus limiting reverse rotation of the pinion to a single revolution for each resharpening or bit repositioning operation. Hydraulic motor reversal necessary to accomplish the bit advancement incrementally is achieved by high speed rotation of the drill casing which activates a centrifugal clutch and an associated hyrdraulic reversing valve coupled to the hydraulic motor.

DETAILED DESCRIPTION

Figure 1:
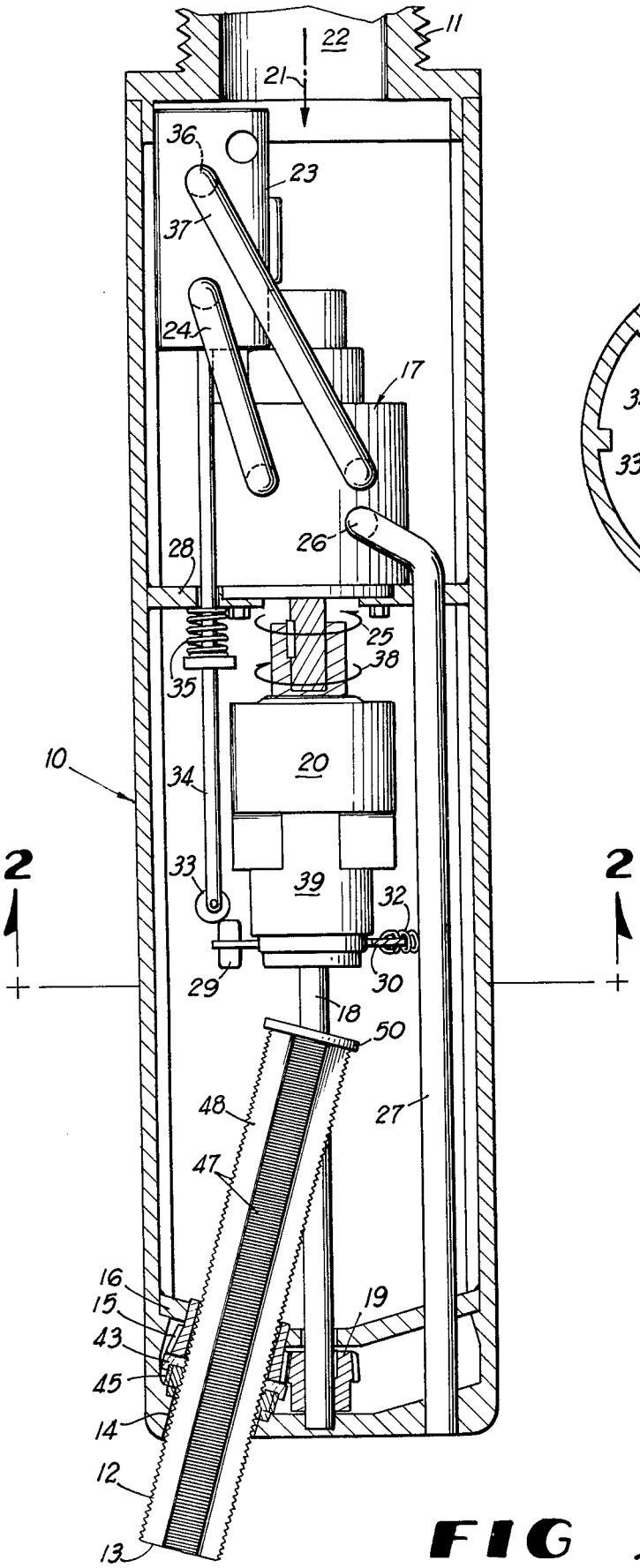
FIG. 1 is a central vertical longitudinal section through the drilling apparatus in the plane of one of the cutting or drilling bits.

Referring to the drawings in detail wherein like numerals designate like parts, a drilling apparatus in accordance with the invention comprises a body or casing section 10 having a rear end threaded adapter 11 through which the apparatus can be attached to a series of pipe sections or "string", not shown. Plural circumferentially spaced oblique axis cutting bits 12 having leading end cutting faces 13 project forwardly of casing section 10 and somewhat radially thereof through openings 14 provided in the forward wall of the casing section.

Each cutting bit 12 is positively rotationally driven by a surrounding individual drive gear 15 mounted within the casing section 10 by means of a bearing plate 16 which prevents axial displacement of the gear rearwardly.

Centrally mounted in the casing section 10 near the rear thereof is a hydraulic motor 17 having a forwardly extending axial shaft 18 coupled to and driving a central pinion gear 19 common to and in mesh with the individual cutting bit drive gears 15 so that the latter may be driven in unison by the pinion gear. A first one-way active clutch 20 is coupled in the shaft 18 between the hydraulic motor 17 and the pinion gear 19.

Hydraulic fluid flowing in the direction of the arrow 21 through the bore 22 at the rear of casing section 10 is directed through a hydraulic valve 23 and thence through a hydraulic line 24 to the hydraulic motor 17 for driving it in the direction shown by the arrow 25 which is the forward or drilling direction of rotation. Motor exhaust port 26 then conducts the hydraulic fluid through a line 27 to the forward face of casing section 10 where it serves to flush away drill cuttings. A wall or baffle 28 in the casing section 10 supports the hydraulic motor 17 and directs hydraulic fluid through the valve 23 which is a reversing valve, as will be further described.

The invention includes, as a main feature thereof, means to reverse the rotation of the cutting bits 12 at proper times in order to effect their incremental advancement. This means comprises a centrifugal weight 29 attached to an arcuate arm 30 which is connected to the casing section 10 by a fixed pivot 31. A spring 32 biases the weight 29 to a radially inward position during the normal drilling mode, wherein the casing section 10 is rotated at a relatively slow speed on its longitudinal axis.

Whenever it is desired to advance and resharpen the cutting bits 12, it is necessary to reverse their direction of rotation in the following manner. The drill string with the casing 10 attached is retracted slightly from the bottom of the well hole to remove cutting pressure from the faces 13 of the bits. Rotation of the casing section 10 is then increased to a much greater than normal rate, sufficient to cause centrifugal weight 29 to move outwardly radially and engage a roller 33 carried by a longitudinal actuator rod 34. This actuator rod is connected conventionally to the hydraulic valve 23 and its movement rearwardly against the force of a return spring 35 causes reversal of the valve 23, whereby hydraulic fluid exits the valve through a port 36 and a line 37 leading to the hydraulic motor 17 resulting in reverse rotation of the motor shaft 18, as indicated by the directional arrow 38, FIG. 1.

Figure 2:
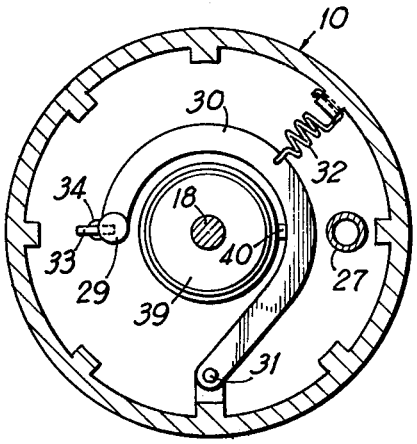
FIG. 2 is a transverse vertical section taken on line 2—2 of FIG. 1.

With the motor 17 now operating in reverse, torque will not any longer be delivered through the one-way clutch 20 to the pinion gear 19, but instead will be delivered through an oppositely active one-way clutch 39, namely, a one-revolution clutch to the pinion gear. As centrifugal weight arm 30 has already engaged a trip lever 40, FIG. 2 of the clutch 39, torque is transmitted reversely in the direction of the arrow 38 to pinion gear shaft 18, rotating it for one revolution only, before the clutch 39 automatically de-activates to stop rotation of shaft 18 and pinion gear 19. Thus, it is seen that in the reverse mode responsive to high speed rotation of the casing section 10, pinion gear 19 will turn in reverse for one revolution only.

Figure 3:
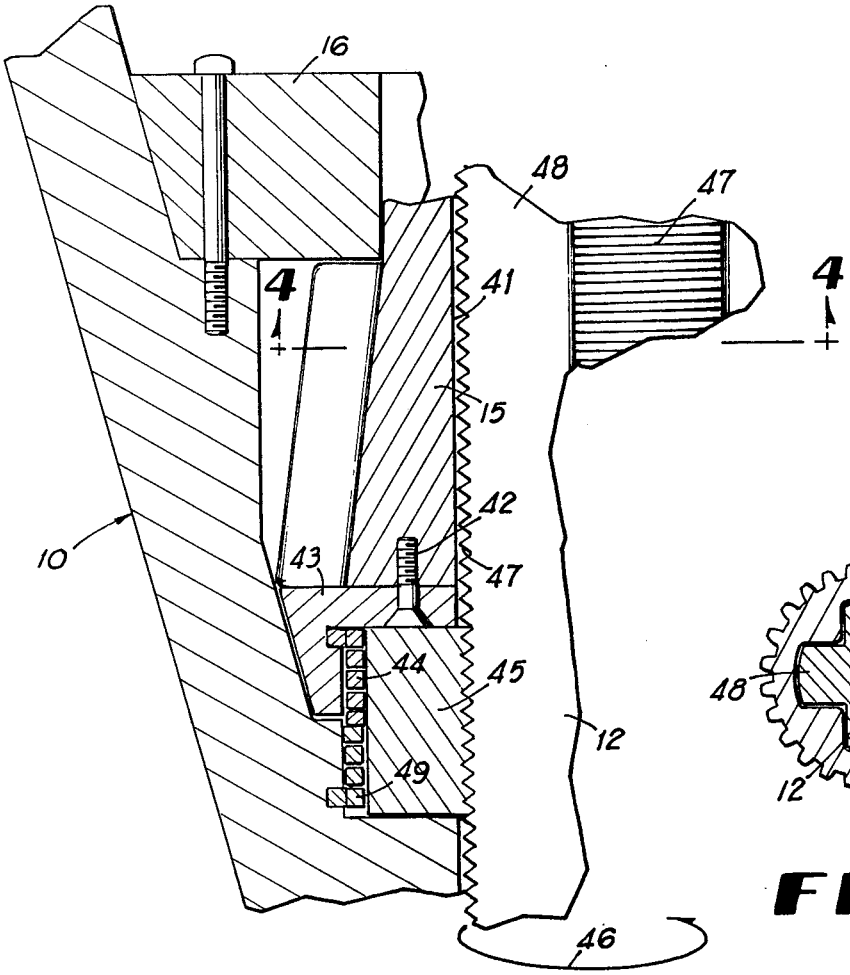
FIG. 3 is an enlarged fragmentary vertical section taken through the plane of one of the cutting bits.
Figure 4:
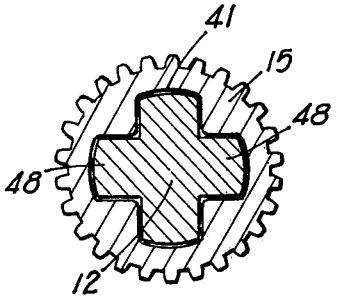
FIG. 4 is a transverse vertical section taken on line 4–4 of FIG. 3 and showing a cutting bit and its associated drive gear.
Figure 5:
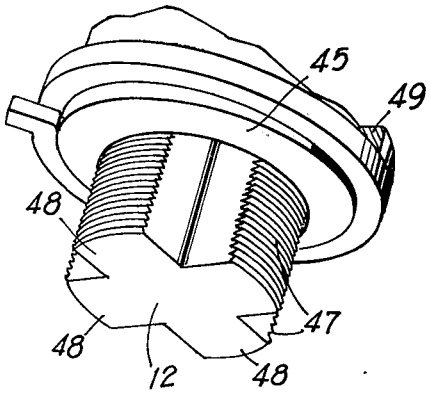
FIG. 5 is a fragmentary perspective view showing a cutting bit in relation to its surrounding threaded locking ring and associated elements.
Figure 6:
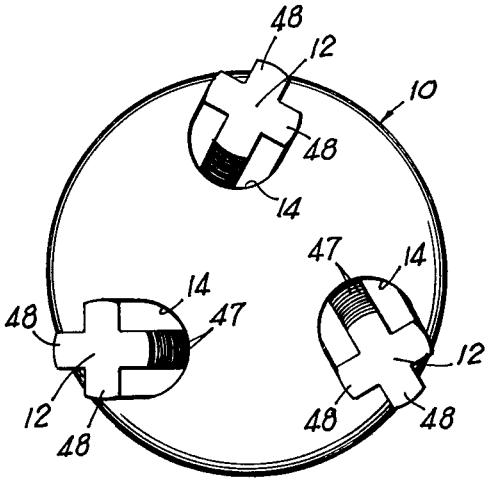
FIG. 6 is a forward end elevational view of the drilling apparatus.

As best shown in FIGS. 3 through 5, each cutting bit drive gear 15 has an axial through opening 41 matching the cross sectional shape of the associated cutting bit 12. This arrangement locks each gear 15 to its cutting bit rotationally but allows relative sliding movement of the bit relative to its drive gear 15.

Attached to each gear 15 as at 42, FIG. 3, is a clutch sleeve 43 which coacts with a one-way clutch spring 44 to cause an associated locking ring 45 surrounding each cutting bit 12 to rotate with the gear 15 in the normal drilling direction indicated by the arrow 46. Since the locking ring 45 is internally screw-threaded and engages external screw-threads 47 on the flutes 48 of cutting bits 12, the locking ring 45 prevents axial displacement of the cutting bit 12 in response to pressure on its leading cutting face 13 during the drilling operation.

However, during reverse rotation of the gears 15 to effect advancement of the cutting bits, the one-way clutch spring 44 will slip, while a second one-way clutch spring 49 of opposite disposition coupling the locking ring 45 with casing section 10 will become active and will prevent rotation of the locking ring 45 relative to the casing section 10. Therefore, during reverse rotation of the bits 12, their screw-threads 47 will cause the bits to be advanced axially out of the casing section 10, thereby presenting a renewed cutting face during the next regular drilling mode. As before stated, this advance of the cutting bits 12 is limited to that incremental length attained by the single reverse revolution of the pinion 19 times the product of the ratio of the diameter of the pinion and the driving gears 15 and the pitch of screw-threads 47.

An integral stop collar 50, FIG. 1, on the rear end of each cutting bit 12 limits the total incremental advance of the bit so that the bit cannot become expelled through the ring gears 15 out of the casing section 10.

In the practice of the drilling method according to the invention, the following sequence of steps takes place.

Normal drilling of the formation proceeds under a fluid pressure within the string and casing 10 of about 1000 psi. When the bits 12 are worn and dull and require advancing, the string with the casing section 10 attached is lifted slightly to relieve the bits 12 of pressure caused by drilling. The relatively high drilling pressure is now cut off so that the reversing valve 23 can open. Immediately thereafter, the rotational speed of the string and casing 10 is greatly increased over normal drilling speed to enable the described centrifugal device to actuate or open the reversing valve. The low pressure, approximately 200 psi, is reapplied to the system. The bits 12 are advanced in unison by an increment representing one complete revolution of the pinion 19. Fluid pressure is now cut off and the four way reversing valve 23 closes so that normal drilling can again take place. The spring 35 returns the rod 34 forwardly at this time. Full drilling pressure, about 1000 psi, is reapplied, the string is again lowered until the bits 12 engage the formation and regular drilling at comparatively low rotational speed can commence.

The invention is characterized by great simplicity, ruggedness of construction, and positiveness and efficiency of operation. In contrast to the known prior art, springs are not relied on alone or in conjunction with fluid pressure to advance the cutting bits and a very positive screw feed is employed for this purpose. The many advantages of the invention over the prior art will be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A drilling apparatus comprising a casing adapted for coupling to a drilling string, plural rotatable and axially movable cutting bits on the leading end of the casing and projecting forwardly thereof, and means to advance said cutting bits incrementally as wear and dulling of their leading ends occurs after periods of drilling, said means comprising a reversible fluid motor, a first one-way clutch coupled with the motor to transmit driving torque produced by the motor during one direction of rotation of the motor, a second one-revolution one-way clutch coupled with the motor to transmit torque produced by the motor during rotation of the motor in an opposite direction, centrifugally operated reversing valve means connected with said motor whereby the motor is operated in a forward drilling mode during slow speed drilling rotation of the casing and is operated in a reverse mode during higher speed rotation of the casing, a pinion gear coupled with the motor through said first and second clutches and adapted to be selectively rotated thereby in opposite directions, cutting bit driving gears mounted on said bits and being rotationally locked thereto but slidable axially relative to said bits, said cutting bit driving gears being in mesh with said pinion gear, the peripheral surface of each cutting bit being screw-threaded, a locking ring on each cutting bit and having a threaded bore engaged with the threads of said bit, and a dual one-way active and one-way inactive clutch means interconnecting each locking ring with said casing and with the adjacent bit driving gear.

2. A drilling apparatus as defined in claim 1, and said centrifugally operated reversing valve means including a centrifugal arm adapted for engagement with a trip lever of said second one-revolution one-way clutch.

3. A drilling apparatus as defined in claim 1, and each cutting bit being of fluted formation, and each cutting bit driving gear having a through opening conforming in cross section to the cross sectional shape of the fluted cutting bit on which it is slidably mounted and locked against relative rotation.

4. A drilling apparatus as defined in claim 1, and said dual one-way active and one-way inactive clutch means including a pair of oppositely disposed clutch springs in surrounding relation to each locking ring, one clutch spring being locked to said casing, and the other clutch spring being locked to a clutch sleeve secured to the adjacent cutting bit driving gear.

5. A drilling apparatus for wells comprising a casing adapted for coupling to a drill string, at least one rotatable and axially movable cutting bit on the leading end of said casing, centrifugally operated reversible motor means to drive said cutting bit selectively in opposite directions of rotation for normal drilling and for advancing the cutting bit to a new operational position on the casing after wear and dulling of the bit, and a dual clutch means coupled between said motor means and said casing and including a part having screw-threaded engagement with said cutting bit.

6. A drilling apparatus as defined in claim 5, and said centrifugally operated reversible motor means including a driving gear on said cutting bit to drive it rotationally on its longitudinal axis and allowing axial movement of the cutting bit relative to the driving gear.

7. A drilling apparatus as defined in claim 6, and said centrifugally operated reversible motor means additionally comprising a hydraulic motor adapted to receive pressurized well head fluid through said casing, a reversing valve for said motor coupled thereto, a rotational drive pinion for said driving gear, a one-way clutch coupled between said motor and pinion, and an oppositely active one-revolution clutch coupled between said motor and said pinion.

8. A drilling apparatus as defined in claim 7, and a centrifugal weight device operatively connected to said one-revolution clutch to activate such clutch responsive to increased rotational speed of said casing.

9. A method of drilling a well comprising the steps of engaging a formation to be drilled with a drilling apparatus attached to a drilling string and having leading end cutting bits adapted to be advanced while the drilling apparatus and string remain in the well, utilizing full well head drilling fluid pressure and comparatively low rotational speed of the drilling apparatus to drive the cutting bits of the apparatus in a regular drilling mode, lifting said drilling string and apparatus slightly in the well to separate the drilling bits from the formation and shutting off said full well head drilling fluid pressure, increasing the rotational speed of the string and drilling apparatus substantially above normal drilling speed and thereby activating a centrifugal device on the drilling apparatus to operate a reversing means for said cutting bits, applying comparatively low fluid pressure within said string and casing, incrementally advancing said cutting bits to new cutting positions, shutting off said low fluid pressure in said casing and string, reapplying said full well head drilling pressure, lowering said string and drilling apparatus in the well until the cutting bits re-engage the formation and continuing to drill the formation with said string and apparatus rotating at regular drilling speed.

10. A method of repositioning the cutting bits of a well drilling apparatus when the bits are worn and dulled without removing the drilling apparatus and bits from the well comprising retracting the drilling apparatus and bits in the well sufficiently to disengage the bits from a formation being drilled by rotation of the apparatus and bits, speeding up the rotation of the apparatus in the well sufficiently to operate a centrifugal reversing means for said bits and thereby rotationally driving the bits in a direction opposite to their normal drilling rotation and during such reverse driving threadably engaging the bits to advance them incrementally on the drilling apparatus to new cutting positions.

11. The method defined in claim 10, and said incremental advancement of said bits being a distance resulting from the turning of a one-revolution driving device in said reversing means.

* * * * *